United States Patent [19]

Reichborn

[11] Patent Number: 4,995,137

[45] Date of Patent: Feb. 26, 1991

[54] APPLIANCE FOR ASH REMOVAL

[75] Inventor: Per K. Reichborn, Greenwich, Conn.

[73] Assignee: Goodway Tools Corporation, Stamford, Conn.

[21] Appl. No.: 393,593

[22] Filed: Aug. 14, 1989

[51] Int. Cl.[5] ..... A47L 5/36

[52] U.S. Cl. ..... 15/327.1

[58] Field of Search ..... 15/327 R, 352, 314, 15/353, 347

[56] References Cited

U.S. PATENT DOCUMENTS 4,476,608 10/1984 Rasmussen ..... 15/353

4,739,535 4/1988 Schuld et al. ..... 15/327 D X

FOREIGN PATENT DOCUMENTS 421664 12/1932 United Kingdom ..... 15/327 R 653053 9/1951 United Kingdom ..... 15/327 R

*Primary Examiner*—Chris K. Moore

*Attorney, Agent, or Firm*—Patrick J. Walsh

[57] ABSTRACT

An appliance for removing soot and ash from a fireplace including a vacuum source, an intermediate container and tubes establishing a vacuum path from a fireplace through the intermediate container to the vacuum source and a disposable bag within the intermediate container forming part of the vacuum circuit for receiving the fireplace refuse and for cooperating with a flame arrester in the container to prevent migration of hot clinkers from the vacuum cleaner and for providing a handy means for final disposal of fireplace refuse without contaminating the appliance.

1 Claim, 2 Drawing Sheets

APPLIANCE FOR ASH REMOVAL

BACKGROUND OF THE INVENTION

The present invention relates to an appliance for removing ash from fireplaces, furnaces, and the like to an intermediate receptacle and for convenient removal from the intermediate receptacle for disposal.

There are several prior art patents of interest in the matter of ash removers. U.S. Pat. No. 1,355,508 to A. E. Roever is directed to a vacuum ash sifter in which an ordinary vacuum cleaner draws ash from a fireplace into an intermediate metal box which is under partial vacuum during operation and which provides temporary storage of the ash removed from the fireplace. After clearing the ash from the fireplace the intermediate metal box is opened at its bottom with the contents dumped into an ash can for disposal.

United Kingdom Patent No. 421,664 to Clarkson et al, is directed to an appliance for attachment to electric vacuum cleaners for removing ash, soot and dirt from fireplaces, stoves, ranges, and domestic boilers. In this patent specification Clarkson et al disclose an appliance in which the vacuum cleaner operating through suitable tubing draws soot and ash from the fireplace into a receptacle within an intermediate container. After the soot and ash are collected the receptacle is then removed from the intermediate container by an operator and dumped into a dust bin.

United Kingdom Patent No. 653,033 specification is also directed to a vacuum cleaning apparatus for removing ashes from a fireplace. The apparatus includes a container and an interior sheet metal basket with a coarse wire mesh bottom for retaining cinders and passing fine clinker into the lowest part of the container. The interior basket is removable for using the clinker for fire lighting. The fine clinker passing into the container is removed to an ash can.

U.S. Pat. No. 4,360,947 is directed to a dust collector utilizing a vacuum cleaner and having an intermediate receptacle, or bucket, and a specially designed scoop for removal into the bucket and ultimate disposal by dumping out the bucket.

U.S. Pat. No. 4,363,674 is directed to a stove and fireplace cleaning method and apparatus and, in particular, a specialized nozzle and furnace inlet for removing ash by means of a vacuum collector. In this case, the ash enters the vacuum collector as there is no intermediate receptacle as in the case of the foregoing patent documents. In the case of the '674 patent, it becomes necessary to dump the ash for final disposal.

Finally, U.S. Pat. No. 4,476,608 is directed to an apparatus for removal of ash from fireplaces and the like by means of a vacuum cleaner and an intermediate container. The '608 patent is directed to the particular geometric configuration of the inlet and outlet opening to the intermediate container located in the lid of the container.

The foregoing group of prior art patents provide for ash removal from a fireplace to an intermediate container largely for the purpose of minimizing the rising of soot and ash and its subsequent settling over the room near the fireplace. The '664 U. K. specification particularly refers to the need arising when ash removal is done by hand use of brush and shovel emptying it into a dust pail and by removal and emptying same into a dust bin. It will be seen, therefore, that each of the prior art patents discussed above provides for removal of ash from a fireplace minimizing the settling of dust and ash in the room, however, the operator is nonetheless left with the rather messy job of finding a final point of disposal for the soot and ash. Additionally, the intermediate container itself will almost always have a residue of soot and ash and at some point the intermediate container and the various component parts, be it removable buckets or trap doors or asbestos screens, must themselves be cleaned. The situation is all too familiar. Every time one tries to remove the ashes from fireplace, barbeque, or wood stove the job require time and effort, not to mention the mess. Then, when the dust settles, it is still not as clean as it could be.

The prior art does address the matter of providing a screen to prevent hot coals or clinkers entering and harming a vacuum cleaner used as a vacuum source. Generally speaking, these include a single screen member of rather coarse mesh and a fine mesh in the case of the U. K. '033 patent specification. It is to be understood, therefore, that the prior art, although well represented on appliances for vacuum ash sifting, is limited and there is, indeed, room for improvement in this field. All that can change now, with the ash removal system of the present invention. It's fast, easy and affordable. And it does the job in one clean sweep—without the mess.

SUMMARY OF THE INVENTION

According to the present invention, an appliance for removing ash from fireplaces includes an intermediate rigid container in a vacuum circuit including a household vacuum cleaner as the vacuum source and suitable hoses for establishing a vacuum path between the intermediate container and the vacuum cleaner and a suitable pick-up hose for drawing ash from the fireplace to the intermediate container. The intermediate container a removable lid and inlet and outlet tube permanently affixed through openings in an upstanding wall of the rigid container. The tubes are conveniently located on opposite sides of the container with the inlet preferably near the top of the container and the outlet near the bottom or lower side wall portion of the container.

This arrangement provides for a vacuum flow inwardly and downwardly through the container and outwardly near the bottom of the container toward the household vacuum cleaner. The inlet opening projects a substantial distance into the interior of the container providing a support for a disposable liner or porous vacuum bag within the container.

The container further includes a flame barrier covering the oulet opening to prevent hot coals from penetrating the rigid container and from entering the interior of the household vacuum cleaner.

It is an important aspect of the invention that a porous vacuum bag be fitted within the container mounted at its inlet end to the inwardly projecting inlet tube and for serving as a collector of soot and ash removed from the fireplace. This arrangement enables the operator to dispose of the porous vacuum bag after one or more fireplace cleanings without having to carry the appliance to a final disposal point, i.e., dust bin or ash can, while at the same time having a clean appliance without ash or soot residue therein.

As an additional feature to the present invention, the porous vacuum bag is itself entirely enclosed except for the inlet tube opening and together with the flame barrier serves as a double filter to prevent ash from leaving the intermediate container and entering the household vacuum cleaner.

OBJECTS OF THE INVENTION

It is an object of the present invention to provide a vacuum powered appliance for ash removal in which the operator is spared the dirty and distasteful chore of final disposal of the ash and the follow-up chore of cleaning the appliance of residual soot and ash each time the appliance is used.

It is a further object of the present invention to provide a convenient disposal bag for collecting the ash within the receptacle allowing the operator to simply remove the bag to the final disposal point without further cleaning steps being required.

It is another object of the present invention to provide an appliance for vacuum ash removal in which the vacuum path includes a double filter in the form of the porous vacuum bag and flame barrier to prevent ash from entering the vacuum source typically a household vacuum cleaner.

DETAILED DESCRIPTION OF THE DRAWING

A preferred embodiment of the invention has been chosen for purposes of illustration and is shown in the accompanying drawing in which.

DETAILED DESCRIPTION OF THE PREFERRED EMBODIMENT

Figure 1:
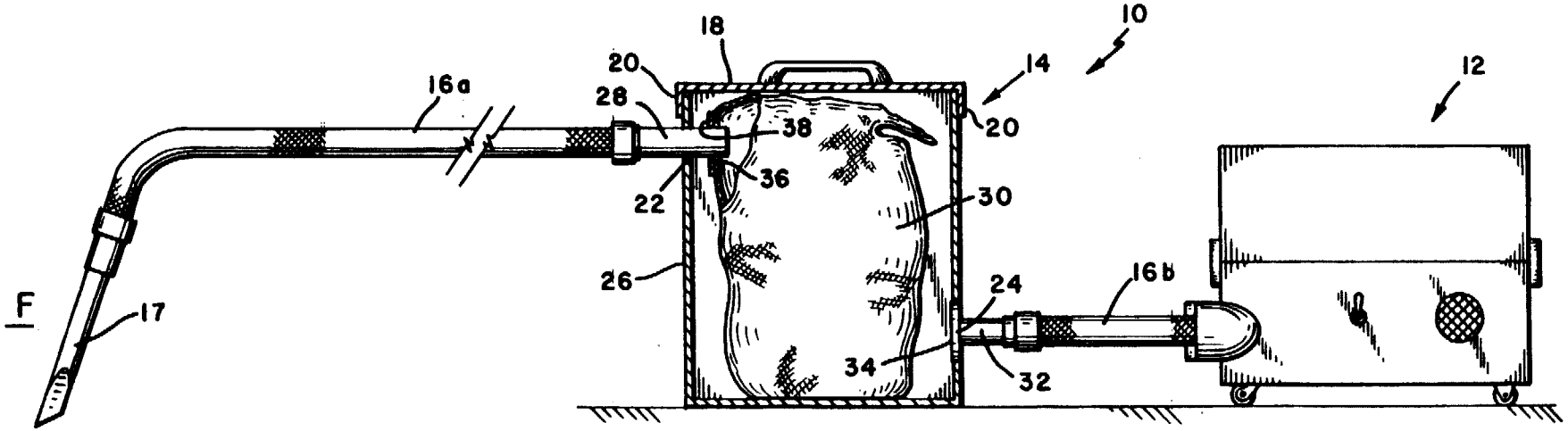
FIG. 1 is a schematic view of the vacuum ash removal appliance according to the present invention.

Referring now to the drawing, the appliance 10 of the present invention is intended to remove ash from a fireplace, barbeque, wood stove, and the like and includes as its principal components a household vacuum cleaner 12, an intermediate collector container 14 and suitable hoses 16*a–b* defining a vacuum path between fireplace F and the household vacuum cleaner. The vacuum cleaner is chosen according to the volume of ash periodically to be removed and can be an ordinary household vacuum cleaner or one of greater capacity if institutional or commercial furnaces are involved. For purposes of describing the preferred embodiment primary reference is to an appliance suitable for household use.

The intermediate container 14 is a rigid container preferably of steel and of suitable capacity as for example a five gallon steel container with a removable cover 18 which is held in place by two or more toggle fasteners 20. The lid and container are provided with suitable packing (not shown) to avoid vacuum loss in operation.

The container includes inlet 22 and outlet 24 opening preferably on opposite sides of the container wall 26 so that the ash pick-up hose 16*a* and its pick up nozzle 17 project from one side toward the fireplace and the outlet vacuum hose 16*b* projects in the opposite direction toward the interior of the room. An inlet tube 28 is welded in place at inlet opening with the tube projecting well into the interior of the container approximately two inches serving as a mounting point for a disposable bag 30 fitted within the container.

An outlet tube 32 is affixed by welding to the outlet opening without projecting into the container and, of course, projecting outwardly from the side wall of the container a suitable distance two to three inches in the preferred embodiment in order to provide a secure connection for the vacuum tubing 16*b*. The interior of the container in the vicinity of the outlet opening is provided with a fine mesh flame retarder 34 to prevent hot coals from passing through the container into the interior of the vacuum cleaner.

Figure 2:
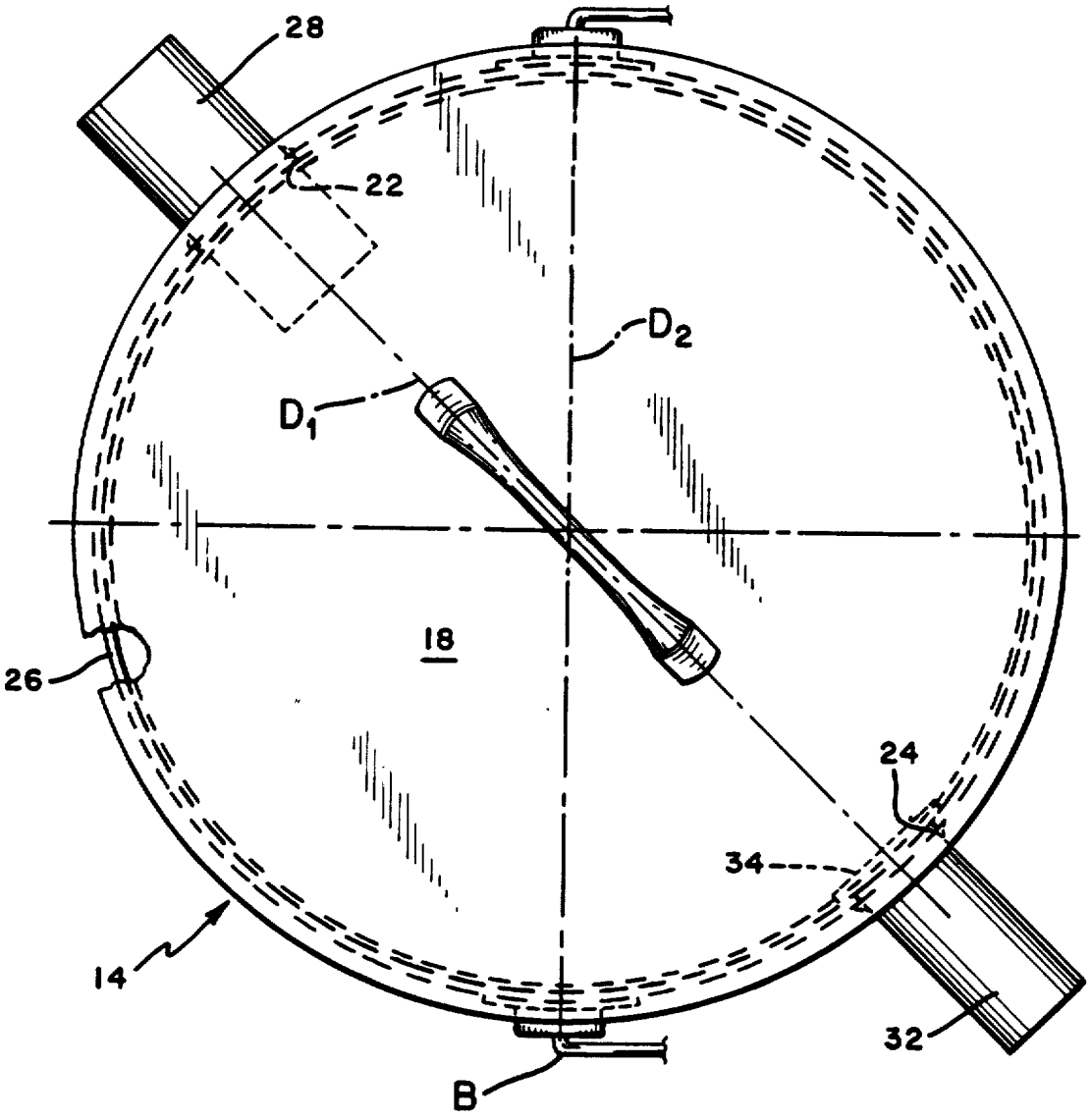
FIG. 2 is a plan view of the intermediate container of the appliance shown in FIG. 1.

Perferably, the inlet tube is located near the top of the container while the outlet tube is located near the container bottom and the inlet and outlet tubes 28, 32 lie along a diametrical plane $D_1$ of the container (FIG. 2). This arrangement allows for an advantageous downward and inward flow of ash in the collector container. Additionally, the container may be provided with a bail B which is secured along a second diameter $D_2$ positioned 45° from the inlet/outlet plane $D_1$. This arrangement is a convenience for suitably positioning the bail with respect to the inlet/outlet openings with minimal interference.

The ash pick-up hose and the outlet vacuum hose are wire-reinforced hose of suitable diameter (typically 1½"–3") for conveying soot and ash without clogging. The interior of the container is fitted with a porous vacuum bag 30 which is entirely enclosed and which has an opening 36 with a reinforced wall portion 38 of complimentary diameter for fitting over the inwardly projecting tube 28 thereby effectively to seal the interior of the container from migration of soot and ash when the appliance is in operation. Additionally, the vaccum bag serves as a first barrier to prevent passage of hot coals through the collector container. The vacuum bag can be of conventional design and of sufficient capacity to occupy the interior of the container and to handle ash ordinary collected from a household fireplace in one or more fireplace cleanings. When full (usually after 5–7 uses) the cover 18 is lifted and the vacuum bag is removed and discarded.

In operation with activation of the vacuum cleaner the appliance will draw ash and soot from a fireplace by establishing a vacuum path from the fireplace to the interior of the disposable bag through the porous bag wall and the fire arrester to the vacuum cleaner. During this operation soot and ash collected and confined to the interior of the disposable bag and the disposable bag itself and the fire arrester acting as a double barrier to migration of hot coals into the vacuum cleaner.

I claim:

1. An applicance for removing ash from a fireplace comprising a vacuum source, an intermediate container, and vacuum hoses attached to the intermediate container and defining a vacuum path from a fireplace through the intermediate container to the vacuum source, the intermediate container having a collector receptacle and a lid adapted for vacuum-tight attachment to the container, an inlet opening in the receptacle side wall to the interior of the receptacle, an inlet tube affixed to the side wall through the inlet opening having one portion thereof projecting into the interior of the receptacle defining a mounting for a vacuum bag and another portion thereof projecting outwardly from the side wall for receiving a vacuum hose defining a vacuum path to the fireplace, an outlet opening and an outlet tube affixed thereto for receiving a vacuum hose for defining the vacuum path to the source, the inlet and outlet tubes being located along a first container diameter on opposite sides of the container, a flame arrester covering the outlet opening, and a vacuum bag fitted to the inlet tube within the container and defining a closed portion of the vacuum path for receiving and containing soot and ash removed from the fireplace and cooperating with the flame arrester as first and second barriers to hot coals passing out of the container into the vacuum source, and a bail affixed along the second diameter displaced approximately 45° from the first diameter.

* * * * *